United States Patent [19]

Anderson et al.

[11] 4,261,255

[45] Apr. 14, 1981

[54] VENTILATION FAN

[75] Inventors: Richard M. Anderson, Nashville; Richard F. Beehler, Franklin, both of Tenn.

[73] Assignee: Heil-Quaker Corporation, Lewisburg, Tenn.

[21] Appl. No.: 82,594

[22] Filed: Oct. 9, 1979

Related U.S. Application Data

[63] Continuation of Ser. No. 921,842, Jul. 3, 1978, abandoned.

[51] Int. Cl.[3] ..... F24F 7/00

[52] U.S. Cl. ..... 98/42 R; 98/43 C; 415/126

[58] Field of Search ..... 98/114, 116, 32, 33 R, 98/43, 43 C, 42 R, 39; 417/360, 361; 415/126, 127, 129

[56] References Cited

U.S. PATENT DOCUMENTS

| | | | |
|---|---|---|---|
| 1,618,379 | 2/1927 | Ilg | 98/39 |
| 2,087,637 | 7/1937 | Burt . | |
| 2,261,391 | 11/1941 | Koch | 417/361 |
| 2,594,688 | 4/1952 | Shapiro . | |
| 2,617,348 | 11/1952 | Sutton | 415/216 |
| 2,619,021 | 11/1952 | Pfantsch | 98/43 |
| 2,710,573 | 6/1955 | Marker | 94/43 |
| 2,828,682 | 4/1958 | Marker | 98/43 |
| 2,885,948 | 5/1959 | Oshins | 98/43 R |
| 3,115,757 | 12/1963 | Day | 98/43 |
| 3,606,593 | 9/1971 | Steiner | 98/43 |

*Primary Examiner*—Henry C. Yuen

*Attorney, Agent, or Firm*—Wegner, Stellman, McCord, Wiles & Wood

[57] ABSTRACT

A ventilation fan which is adapted to be ceiling mounted such as in an attic space above a room ceiling. The fan is arranged to pass upwardly through the space between the ceiling joists in a compact arrangement and to be extended once it is disposed above the room ceiling to define an operating configuration. In the operating configuration, the air moving apparatus is swung outwardly from the housing of the fan on a pivotally mounted wall portion thereof. The fan redirects the upwardly flowing air from the subjacent room at a substantial angle to the vertical in the attic space for improved ventilation functioning.

12 Claims, 2 Drawing Figures

Fig. 1
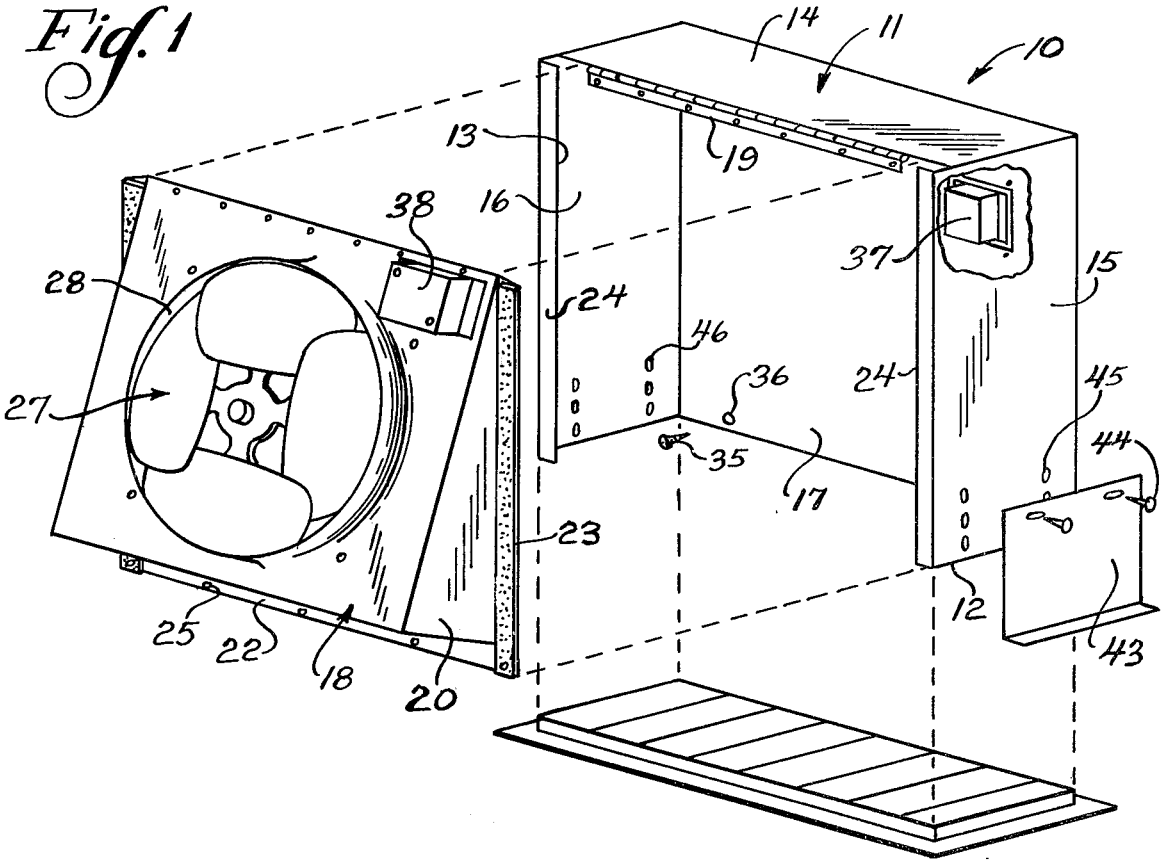
Fig. 2
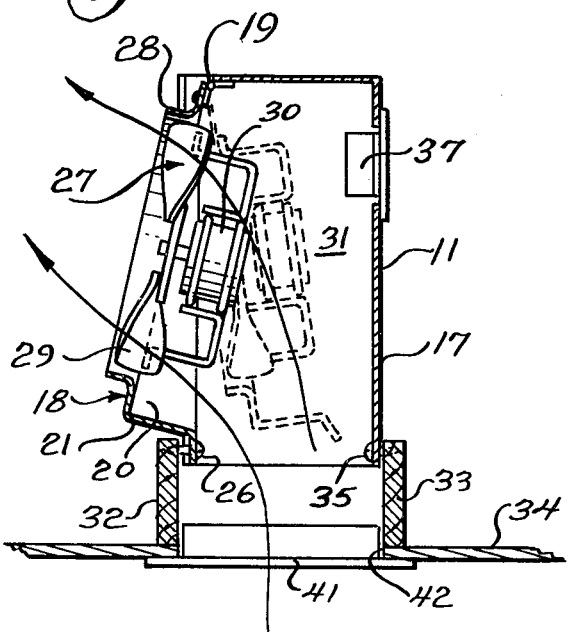
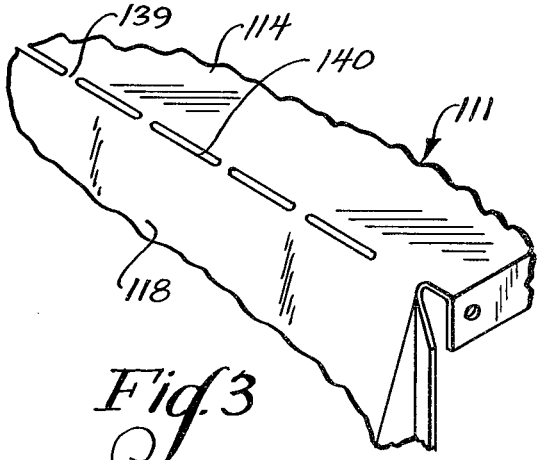
Fig. 3

VENTILATION FAN

This is a continuation of application Ser. No. 921,842, filed July 3, 1978, now abandoned.

BACKGROUND OF THE INVENTION

1. Field of the Invention

This invention relates to ventilating fans and in particular to ceiling mounted ventilating fans.

2. Description of the Prior Art

In U.S. Pat. No. 2,594,688 of Eli Shapiro, a window cooler is illustrated having a hinged door carrying the motor driven fan to provide facilitated servicing.

William M. Marker, in U.S. Pat. No. 2,710,573, shows an air handling apparatus which, in FIG. 14 thereof, is adapted to be installed between the rafters of a ceiling.

Allen W. Lundstrum, in U.S. Pat. No. 2,770,955, shows an air conditioning device adapted to be installed in an attic with the lower portion thereof received between the rafters.

U.S. Pat. No. 3,425,621, of Robert C. Greenheck, discloses an inline centrifugal fan having the air moving means mounted to a wall hingedly mounted to the housing for facilitated servicing.

William R. Traham, in U.S. Pat. No. 3,559,560, shows a ceiling box for distributing air adapted to be secured to a rafter with the box being disposed between a pair of rafters.

In U.S. Pat. No. 3,606,593, Robert E. Steiner shows an exhaust fan wherein the air is turned 90 degrees from the inlet to the outlet thereof.

SUMMARY OF THE INVENTION

The present invention comprehends an improved ventilator structure which is adapted to be moved upwardly between a pair of ceiling rafters to a mounting disposition thereabove. The ventilator structure is arranged to be disposed in a retracted compact configuration to permit such upward movement of the unit between the rafters to the mounting disposition and includes means to permit the air moving means thereof to be swung out from the compacted configuration into a normal operating configuration overlying one of the rafters. Thus, in the operating configuration, the ventilator structure has a transverse dimension larger than the spacing between the rafters.

The ventilator structure is arranged to turn the air from the vertical inlet and in the illustrated embodiment, discharges the air upwardly at an angle of approximately 30° to the horizontal, or approximately 120° from the inlet flow direction.

In the illustrated embodiment, the air moving means comprises a motor driven fan which is carried on a wall member hingedly mounted to the housing of the ventilator structure. Further in the illustrated embodiment, the wall member is hingedly mounted at its upper edge portion of a top wall portion of the housing.

Means may be provided for securing the lower end of the wall member in the hingedly outwardly extended disposition. The wall member may include sidewall portions and a bottom wall portion enclosing the air moving means in the extended disposition of the wall member to assure desired air flow from the inlet of the housing outwardly through the air moving means and outlet opening in the wall member.

In one form of the invention, the wall member is formed integrally with the top wall of the housing and the hinge means comprises a bendable connection between the wall member and the top wall of the housing. In the illustrated embodiment, the connection is provided with cutouts to facilitate the bending thereof.

In the operating configuration, the air moving means is partially disposed within the parallelepiped housing and partially disposed outwardly thereof within the extended space defined by the hinged wall member, including the sidewall and bottom wall portion thereof.

In the retracted, compact configuration of the ventilator structure, the air moving means is disposed fully within the parallelepiped housing thereof for facilitated handling in moving the structure upwardly between the ceiling joists to the installed disposition.

Thus, the ventilator structure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is an exploded perspective view of a ventilator structure embodying the invention;

FIG. 2 is a vertical section thereof with the air moving means carried on the hinged wall in extended operating disposition in full lines, and with the air moving means shown in retracted disposition within the housing of the ventilator structure in broken lines; and FIG. 3 is a fragmentary perspective view illustrating a modified form of hinge means for use in hingedly connecting the air moving means wall to the upper wall of the housing.

DESCRIPTION OF THE PREFERRED EMBODIMENT

In the exemplary embodiment of the invention as disclosed in the drawing, a ventilator structure generally designated 10 is shown to include a generally parallelepiped housing 11 having an open bottom 12 and an open front 13. The housing includes a top wall 14, sidewalls 15 and 16, and a rear wall 17, as illustrated in FIG. 1.

The ventilator structure further includes a front wall member 18 which may be hingedly secured to the top wall 14 of housing 11 by suitable means, such as hinge 19. The front wall member may include sidewall portions 20 and a bottom wall portion 21. A peripheral flange 22 extends along the rear edges of the sidewall portions 20 and bottom wall portion 21 and may be provided with sealing means 23 along the sidewall portions 20 adapted to have sealing engagement with inturned flanges 24 on the housing sidewalls 15 and 16, respectively, when the front wall member 18 is swung outwardly on hinge 19 to an operating disposition, as shown in full lines in FIG. 2.

The portion of the flange 22 underlying the rear of bottom wall 21 may be provided with suitable apertures 25 for passing securing means, such as screws 26, therethrough such as for use in securing the ventilator structure in the operating position, as shown in FIG. 2.

More specifically, wall member 18 carries an air moving means generally designated 27 which, in the illustrated embodiment, comprises a motor driven fan. The wall member defines an outturned annular flange 28 defining a discharge duct in which the fan 29 of the air moving means is disposed. As shown in FIG. 2, the fan motor 30 may be disposed within the space 31 defined by the parallelepiped housing 11.

As indicated above, the ventilator structure of the present invention is adapted for faciliated installation by facilitated movement upwardly between the ceiling joists of a building construction. Thus, as shown in FIG. 2, the wall member 18 may be hingedly swung rearwardly toward the rear wall 17 of the housing on hinge 19 so as to dispose the air moving means 27 fully within the space 31 in a retracted, compact configuration of the ventilator structure, permitting facilitated movement thereof upwardly between a pair of floor joists, such as floor joists 32 and 33, of a room ceiling 34. Upon elevating the ventilator structure to the position of FIG. 2, the housing 11 may be secured to the floor joists by the above mentioned screws 26 and screws 35, screws 35 being insertable through suitable holes 36 in rear wall 11 so as to secure the lower end of the rear wall to the joists 33.

As seen in FIG. 2, when the front wall 18 is swung outwardly to the operating position shown in full lines therein, the lower flange portion is brought to adjacent the upper end of the joists 32, permitting the screws 26 to be passed through the apertures 25 into the joist 32 to complete the mounting of the ventilator structure to the building joists.

The ventilator structure may include a suitable control, such as control 37, which may comprise a conventional modulating speed control for improved operation of the ventilator fan. An additional control 38 may be provided on the wall member 18, as shown in FIG. 1, for controlling the operation of the ventilator structure as desired.

In a modified form of the invention, as illustrated in FIG. 3, the front wall member generally designated 118 may be integrally connected to the top wall member 114 of the housing 111 by a foldable connecting portion 139 which may be provided with suitable slots 140 for controlled folding of the connector portion in the manner of a hinge.

In the illustrated embodiment, the sidewalls 20 define triangular sidewalls so that when the flange 22 is in abutment with the joists 32, the front wall member extends at an angle of approximately 120° to the vertical, i.e. upwardly at an angle of approximately 30° to the horizontal. The bottom 12 of the housing defined by the lower end of rear wall 17 and lower ends of sidewalls 15 and 16, together with the lower end of flange 22, opens vertically downwardly through the space between the joists 32 and 33. Thus, the ventilator structure of the present invention effects a turning of the air flow from a vertically upward direction to an inclined upward direction which is at a relatively small angle to the horizontal, such as 30°, as discussed above. It has been found that this improved delivery of the ventilating air into the attic space, or other space above the ceiling 34, provides improved ventilating of the subjacent room. As will be obvious to those skilled in the art, the specific angle of the front wall 18 may be preselected by appropriate configuration of the sidewalls 20 and bottom wall 21 of the front wall member. The configuration of the front wall member is such, however, that the front wall and air moving means carried thereon is effectively recessed within space 31, as shown in dotted lines in FIG. 2, in the retracted disposition to permit the desirable upward movement of the structure between the joists 32 and 33, as discussed above, in effecting the facilitated installation of the ventilator structure of the present invention.

An air inlet grill 41 may be provided for closing the opening 42 in the ceiling 34 subjacent the ventilator structure as desired. A pair of skirts 43 may be provided which may be adjustably secured to the sidewalls 15 and 16 by suitable screws 44 adapted to be received selectively in any one of a plurality of openings 45 and 46, provided in the lower ends of the sidewalls 15 and 16, respectively. These skirts close off the openings between the bottom portions of sidewalls 15 and 16 and the ceiling 34.

Thus, it may be seen that the improved exhaust fan form of ventilator structure illustrated in the drawing includes a housing having a top wall and at least three sidewalls defining an air chamber. A fourth sidewall is pivotally connected to at least one of the walls of the housing to carry an air moving means selectively positionable in a retracted position within the housing and in an operating position wherein the air moving means extends at least partially outwardly from the housing. The improved selectively positionable arrangement of the air moving means supporting wall permits the ventilator structure to be passed readily through the relatively narrow space between ceiling joists while yet the ventilator structure in its operating arrangement is extended to overlie at least one of the joists in an expanded volumetric configuration. The movable wall may be secured in the extended arrangement, and in the illustrated embodiment, the means for securing the movable wall in the extended arrangement further serves to secure the ventilator structure to as least one of the joists.

The means for hingedly mounting the movable wall to the housing may comprise any suitable hinge means and in one improved form comprises an integral, or living, hinge.

By exhausting the air generally horizontally from the ventilator structure into the attic space, reduced turbulence results, thereby providing improved efficiency in the operation of the air moving means.

The foregoing disclosure of specific embodiments is illustrative of the broad inventive concepts comprehended by the invention.

Having described the invention, the embodiments of the invention in which an exclusive property or privilege is claimed are defined as follows:

1. A ventilator structure comprising:

wall means defining a housing having a bottom inlet opening and a side outlet opening;

a wall member defining a discharge duct;

air moving means carried by said wall member; and mounting means movably mounting said wall member and air moving means carried thereby to said wall means for selective repositioning thereof from a retracted position wherein said duct and air moving means are disposed within said housing for effectively minimizing the transverse size of the ventilation structure as during installation thereof, to an operative position wherein said duct projects substantially outwardly from said outlet opening at an angle to the vertical for delivering air from said housing at said angle to the upward direction of flow into said inlet opening.

2. The ventilator structure of claim 1 wherein said housing is substantially parallelepiped.

3. The ventilator structure of claim 1 wherein said mounting means disposes said air moving means at an upward angle of approximately 120° to the vertical.

4. The ventilator structure of claim 1 wherein said mounting means comprises hinge means hingedly mounting said member to a portion of said housing adjacent said outlet opening.

5. The ventilator structure of claim 1 wherein said housing is substantially parallelepiped and said outlet opening defines a substantially fully open side of said housing.

6. The ventilator structure of claim 1 wherein said mounting means comprises hinge means hingedly mounting said wall member to a portion of said housing adjacent the top of said outlet opening and means for securing the wall member in an upwardly inclined angular disposition to support said air moving means in said operative position.

7. A ventilator structure comprising:

first wall means defining a housing having a bottom inlet opening and a side outlet opening;

air moving means;

second wall means hingedly mounted to said housing and defining a discharge duct; and means mounting said air moving means to said second wall means for selective repositioning of said second wall means and air moving means mounted thereon from a retracted position wherein said duct and air moving means are disposed within said housing for effectively minimizing the transverse size of the ventilation structure as during installation thereof, to an operative position wherein said duct projects substantially outwardly from said outlet opening at a large angle to the vertical for delivering air from said housing at a substantial angle to the upward direction of flow into said inlet opening.

8. The ventilator structure of claim 7 wherein said housing is dimensioned for passage through a ceiling opening between adjacent ceiling joists only when said second wall means is positioned in said housing.

9. The exhaust fan of claim 8 wherein said second wall means is hingedly mounted to said housing.

10. A ceiling mounted exhaust fan comprising:

a housing consisting of a top wall and four sidewalls, one of said sidewalls defining a duct and having an exhaust opening therein and being connected hingedly to said top wall;

a fan and electric driving motor therefor operably mounted on said one sidewall, said one hingedly connected sidewall with said fan and motor mounted thereon being movable fully inwardly into the space defined by the three other sidewalls and top wall, said housing being dimensioned for passage through a ceiling opening between adjacent ceiling joists when said one sidewall, fan and driving motor mounted thereon are so disposed fully within said space; and retaining means for fixedly connecting said one sidewall to at least one of the three other sidewalls in an operative disposition wherein said one sidewall projects substantially outwardly from said space.

11. The ceiling mounted exhaust fan of claim 10 wherein said retaining means disposes said hinged one wall at an upward angle to the horizontal.

12. The ceiling mounted exhaust fan of claim 10 wherein said retaining means disposes said hinged one wall with said fan and electric driving motor partially within and partially without said housing.

* * * * *